United States Patent [19]

Muskus

[11] 4,112,816

[45] Sep. 12, 1978

[54] METHOD OF MAKING A CORD HAMMOCK

[75] Inventor: Meryl L. Muskus, Chicago, Ill.

[73] Assignee: The Raymond Lee Organization, Inc., New York, N.Y. ; a part interest

[21] Appl. No.: 820,438

[22] Filed: Aug. 1, 1977

[51] Int. Cl.[2] ..... A45F 3/22; A47C 17/84; D04G 1/00

[52] U.S. Cl. ..... 87/12; 5/120; 87/13; 289/1.5

[58] Field of Search ..... 87/8, 11, 12, 13, 53; 289/1.2, 1.5, 18; 5/120–126

[56] References Cited

U.S. PATENT DOCUMENTS

| | | | |
|---|---|---|---|
| 277,161 | 5/1883 | Rood | 87/13 |
| 296,460 | 4/1884 | Rood | 5/120 |
| 296,627 | 4/1884 | Rood | 5/120 |
| 408,207 | 8/1889 | Brayshaw | 5/120 |
| 459,043 | 9/1891 | Knoernschild | 5/120 |
| 487,857 | 12/1892 | Rood | 87/13 |
| 4,062,586 | 12/1977 | Ortize | 5/120 X |

*Primary Examiner*—John Petrakes
*Attorney, Agent, or Firm*—Daniel Jay Tick

[57] ABSTRACT

A cord hammock is made by knotting a plurality of long strands of cord in a manner whereby they are braided at the ends of the hammock and branch out to form a body supporting pattern.

1 Claim, 4 Drawing Figures

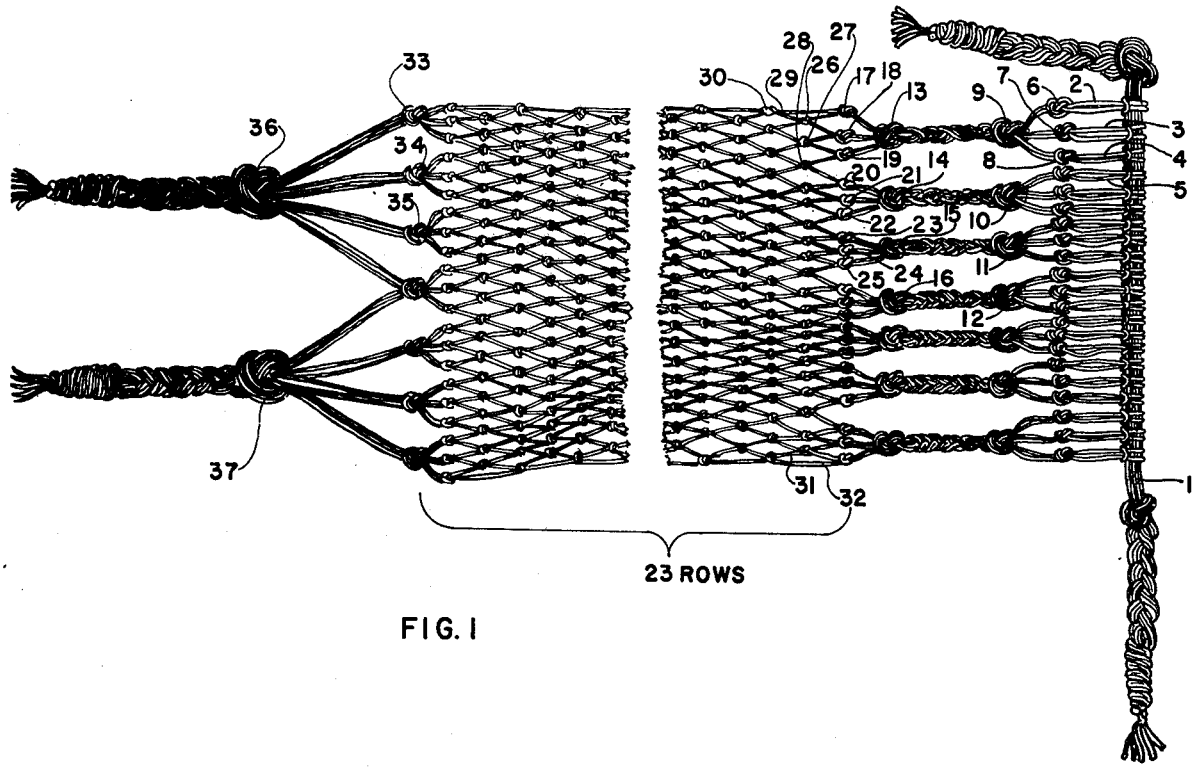
FIG. 1
FIG. 2
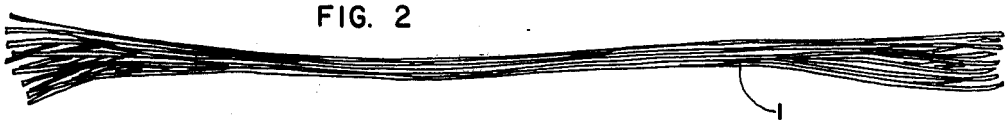
FIG. 3
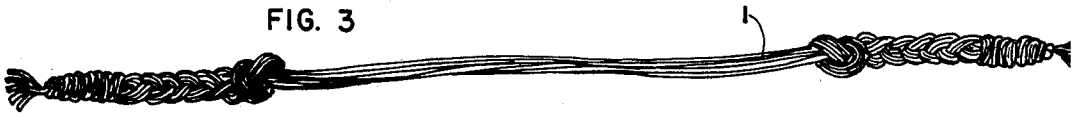
FIG. 4
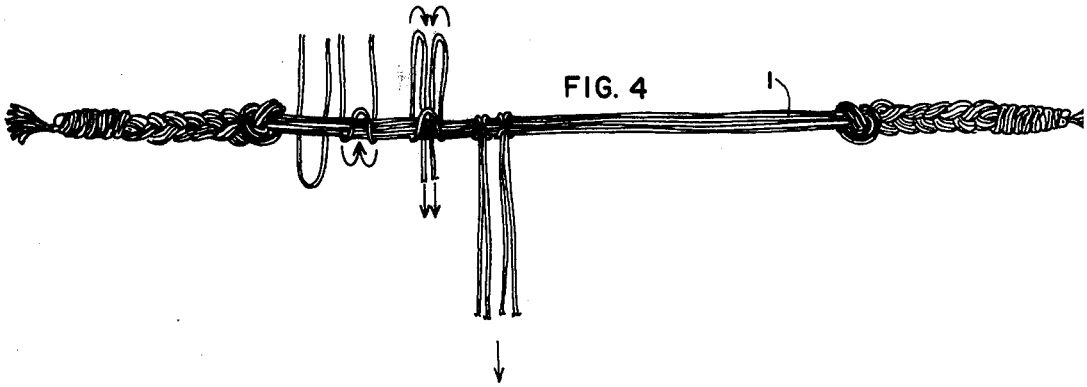

METHOD OF MAKING A CORD HAMMOCK

BACKGROUND OF THE INVENTION

The present invention relates to a method of making a cord hammock.

Objects of the invention are to provide a method of making a cord hammock, which method involves a plurality of simple knotting operations on a plurality of lengths of cord, in a macrame operation. The hammock is attractive and pleasant in appearance and is comfortable in use.

BRIEF DESCRIPTION OF THE DRAWINGS

In order that the invention may be readily carried into effect, it will now be described with reference to the accompanying drawings, wherein:

FIG. 1 is a view of a hammock made by the method of the invention;

FIG. 2 is a view of lengths of cord utilized at the beginning of the method of the invention;

FIG. 3 illustrates knotting of 12 strands of cord at two points spaced from each other, in accordance with one of the steps of the method of the invention; and FIG. 4 illustrates the making of Lark Head Knots in accordance with the method of the invention.

DETAILED DESCRIPTION OF THE INVENTION

The method of making a cord hammock of the invention comprises the steps of cutting a length of cord into 23 strands 28 feet long, as shown in FIG. 2.

Two of the strands are cut into 12 4-foot 8-inch long strands, so that 21 strands remain in the 28 foot length.

The 12 strands are overhand knotted at two points 9 inches from each end, as shown in FIG. 3. The 12 strands are braided and an overhand knot is tied to end each braid, leaving a few inches of tassle thereby completing the mounting cord 1, as shown in FIG. 1. The mounting cord 1 is then extended taut. This may be accomplished by clamping its ends to spaced mounts in a manner whereby the mounting cord extends substantially horizontally.

As shown in FIG. 1, each of the 21 strands 2, 3, 4, 5, and so on, is tied on the mounting cord 1 by Lark Head Knots thereby having 21 knots making 42 single strands.

A first overhand knot 6, 7, 8, and so on, is tied in each double strand 5 inches down from the Lark Head Knot.

One large second overhand knot 9, 10, 11, 12, and so on, is then tied 2 inches down from the first overhand knots 6, 7, 8, and so on, with each three first overhand knots, forming a row of seven large knots 9, 10, 11, 12, and so on.

Each six strand bundle is then braided about 4 inches. Seven additional overhand knots 13, 14, 15, 16, and so on, are then tied to end the braids.

The six strands are separated into twos, and three overhand knots 17, 18 and 19, 20, 21 and 22, 23, 24 and 25, and so on, are tied 1 inch down from each of the seven knots 13, 14, 15, 16, and so on, forming a row of 21 knots 17, 18, 19, 20, 21, 22, 23, 24, 25, and so on, and a row of 42 loose strands. Skipping the first strand, an overhand knot 26, 27, 28, and so on, is tied 2 inches down in the second and third strands, the fourth and fifth strands, the sixth and seventh strands, and so on, leaving the 42 strand.

The first strand 29 is tied to the second strand in a knot 30. The third and fourth strands are tied to each other, as are the fifth and sixth strands, ending in tying the 41 and 42 strands 31 and 32.

The two preceding steps of tying the second and third strands, the fourth and fifth strands, and so on, and tying the first strand to the second strand, the third and fourth strands, the fifth and sixth strands, and so on, are repeated until 23 rows are formed, as shown in FIG. 1.

An overhand knot 33, 34, 35, and so on, is then tied 3 inches down with each three double strands to form a last row of seven large knots 33, 34, 35, and so on.

The 42 strands are divided into two sections of two large overhand knots 36 and 37 and are tied 5 inches down from the last row.

Each strand in then braided about 6 inches down to form the other end of the hammock.

While the invention has been described by means of a specific example and in a specific embodiment, I do not wish to be limited thereto, for obvious modifications will occur to those skilled in the art without departing from the spirit and scope of the invention.

Cord patterns and methods of making cord patterns similar to the method described in the present application are disclosed in the following U.S. Pat. No. 296,627, issued to Rood on Apr. 8, 1884, No. 408,207, issued to Brayshaw on Aug. 6, 1889, No. 459,043, issued to Knoernschild on Sept. 8, 1891, No. 980,829, issued to Palm et al on Jan. 3, 1911 and No. 3,837,019, issued to Hoff on Sept. 24, 1974.

I claim:

1. A method of making a cord hammock, comprising the steps of cutting a length of cord into 23 strands 28 feet long;

cutting two of the strands into 12 4-foot 8-inch long strands;

knotting the 12 strands at two points 9 inches from each end to provide a mounting cord;

braiding the 12 strands from each knot and tying an overhand knot to end each braid, leaving a few inches of tassle thereby completing the mounting cord;

extending the mounting cord taut;

tying each of the 21 strands on the mounting cord by Lark Head knots thereby having 21 knots making 42 single strands;

tying a first overhand knot in each double strand 5 inches down from the Lark Head Knot;

tying one large second overhand knot 2 inches down from the first overhand knots with each three first overhand knots, forming a row of seven large knots;

braiding each six strand bundle about 4 inches;

tying seven additional overhand knots to end the braids;

separating the six strands into twos and tying three overhand knots 1 inch down from each of the seven knots, forming a row of 21 knots and a row of 42 loose strands, and skipping the first strand, tying an overhand knot 2 inches down in the second and third strands, the fourth and fifth strands, the sixth and seventh strands, and so on, leaving the 42nd strand;

tying the first strand to the second strand, and third and the fourth strands, the fifth and the sixth strands, and so on, ending in tying the 41st and 42nd strands;

repeating the two preceding steps until 23 rows are formed;

tying an overhand knot 3 inches down with each three double strands to form a last row of seven large knots;

dividing the 42 strands into two sections and tying two large overhand knots 5 inches down from the last row; and braiding both strands about 6 inches down.

* * * * *